US005929564A

United States Patent [19]

Nakaya et al.

[11] Patent Number: 5,929,564

[45] Date of Patent: Jul. 27, 1999

[54] FLUORESCENT LAMP

[75] Inventors: Tomio Nakaya; Mitsunari Yoshida, both of Kanagawa-ken; Toshiyuki Terada, Tokyo; Tomonori Abe, Kanagawa-ken, all of Japan

[73] Assignee: Stanley Electric Cp., Ltd., Tokyo, Japan

[21] Appl. No.: 08/902,232

[22] Filed: Jul. 29, 1997

[51] Int. Cl.[6] ..... H01J 65/04; H01J 61/06

[52] U.S. Cl. ..... 313/607; 313/234; 313/594; 313/634

[58] Field of Search ..... 313/607, 234, 313/594, 635, 485, 491

[56] References Cited

U.S. PATENT DOCUMENTS 5,006,758 4/1991 Gellert et al. ..... 313/607 X
5,343,114 8/1994 Beneking et al. ..... 313/607 X
5,581,152 12/1996 Matsuno et al. ..... 313/234 X
5,666,026 9/1997 Matsuno et al. ..... 313/234 X

FOREIGN PATENT DOCUMENTS 7-272694 10/1995 Japan .

*Primary Examiner*—Ashok Patel
*Attorney, Agent, or Firm*—Weingarten, Schurgin, Gagnebin & Hayes LLP

[57] ABSTRACT

Since the internal electrode of a fluorescent lamp comprises a base portion made from a transparent glass member having substantially the same thermal expansion coefficient as that of a tubular glass bulb and shaped like a pipe or rod and a conductive and transparent film formed on the surface of the base portion, the thermal expansion coefficient of the internal electrode is made equal to that of the tubular glass bulb to prevent damage caused by temperature variations, and the entire internal electrode 4 is transparent so that all the beams from the fluorescent film can be radiated to the outside without being shaded.

2 Claims, 1 Drawing Sheet

PRIOR ART

FLUORESCENT LAMP

BACKGROUND OF THE INVENTION

1. Field of the Invention

This invention relates to a fluorescent lamp and, more specifically, to a fluorescent lamp in which electricity is discharged between an internal electrode which extends through a discharge chamber formed by a tubular glass bulb in an axial direction and an external electrode provided around the tubular glass bulb through the tubular glass bulb, that is, a dielectric.

2. Background Art

The configuration of this type of a conventional fluorescent lamp 90 (as disclosed by Laid-open Patent Application No. Hei 7-272694) in which electricity is discharged through a dielectric is such as shown in FIG. 2 that an internal electrode 93 formed from a conductive member such as a metal extends in an axial direction of a tubular glass bulb 92 forming a discharge chamber 91 and is welded at welding portions 93*a,* a fluorescent film 94 is formed on the interior wall of the tubular glass bulb 92, and an external electrode 95 is formed by winding a metal wire, for example, around the tubular glass bulb 92.

Since a discharge space is made small by reducing the distance between the inner electrode 93 and the interior wall of the tubular glass bulb 92, that is, the fluorescent film 94, both a discharge start voltage and a light-up voltage can be set to a low level, which is convenient for use. Therefore, a bar-shaped or pipe-shaped metal member is used as the internal electrode 93

However, the fluorescent lamp 90 of the prior art configured as described above has the following problems. Firstly, since the internal electrode 93 is shaped like a pipe, it is strong. In addition, since both ends of the internal electrode 93 are fixed to the tubular glass bulb 92 at the welding portions 93*a,* the difference of thermal expansion coefficient between the tubular glass bulb 92 and the internal electrode 93 at the time of use, for example, lighting, cannot be ignored.

In other words, when a temperature rise is caused by discharge at the time of lighting, there is produced a size difference between the internal electrode 93 made from a metal having a relatively large thermal expansion coefficient and the tubular glass bulb 92 made from glass having a relatively small thermal expansion coefficient. Stress produced by the size difference centers on the connection portions 93*a,* thereby causing a crack and damaging the fluorescent lamp 90.

Secondly, the fluorescent film 94 radiates light in two directions: an interior surface side and an exterior surface side. Thereby, the brightness of the fluorescent lamp 90 in one direction is a total value of straight light from the fluorescent film 94 facing that direction and light from the fluorescent film 94 on a rear side passing through the fluorescent film 94 facing that direction.

However, when the internal electrode 93 is shaped like a thick pipe, the internal electrode 93 made from a metal shades light from the fluorescent film 94 on a rear side. This shading occurs in all radiation directions of the fluorescent lamp 90 with the result that all beams of the fluorescent lamp 90 are lost.

Thirdly, when the internal electrode 93 is shaped like a thick pipe, its electrical resistance becomes low. If a portion having a low discharge resistance is produced between the internal electrode 93 and the external electrode 95 in this state, a large current is supplied to that portion because the resistance value of the internal electrode 93 is low with the result of the concentration of discharge. In an extreme case, a hole is formed in the tubular glass bulb 92 and the fluorescent lamp 90 loses its function. Solutions to these problems have been awaited.

SUMMARY OF THE INVENTION

As means for solving the above problems of the prior art, the present invention provides a fluorescent lamp comprising a tubular glass bulb forming a discharge chamber, an interval electrode aligned with the axis of the tubular glass bulb in the discharge chamber, a fluorescent film formed on the interior wall of the tubular glass bulb and an external electrode provided around the tubular glass bulb, wherein the internal electrode comprises a base portion formed from a transparent glass member having substantially the same thermal expansion coefficient as that of the tubular glass tube and shaped like a pipe or rod and a conductive transparent film formed on the surface of the base portion.

BRIEF DESCRIPTION OF THE DRAWINGS

These objects and advantages of the present invention will become clear from the following description with reference to the accompanying drawings, wherein.

DETAILED DESCRIPTION OF THE PREFERRED EMBODIMENTS

Figure 1:
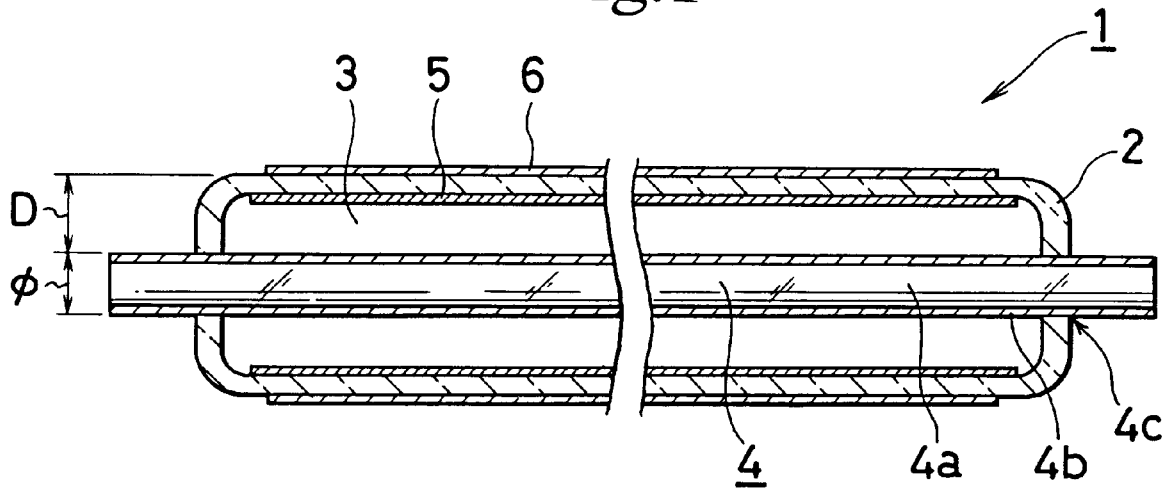
FIG. 1 is a sectional view of a fluorescent lamp according to an embodiment of the present invention.
Figure 2:
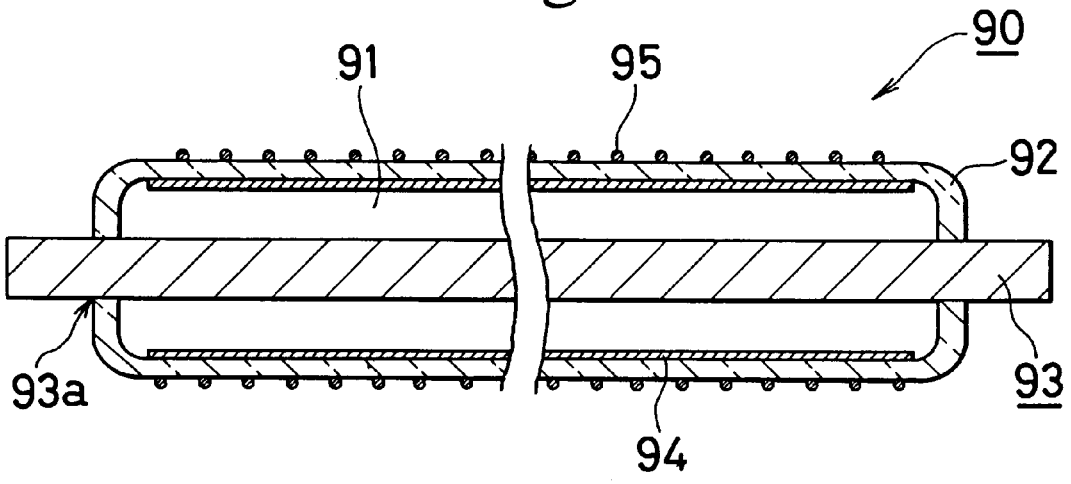
FIG. 2 is a sectional view of the prior art.

The present invention is described in detail with reference to a preferred embodiment shown in the accompanying drawing. In FIG. 1, reference numeral 1 denotes a fluorescent lamp according to the present invention. Like the prior art, this fluorescent lamp 1 comprises a tubular glass bulb 2 forming a discharge chamber 3, an internal electrode 4 aligned with the axis of the tubular glass bulb 2 in the discharge chamber 3 and welded to the tubular glass bulb 2 at both ends, a fluorescent film 5 formed on the interior wall of the tubular glass bulb 2, and an external electrode 6 provided around the tubular glass bulb 2.

In the present invention, the internal electrode 4 comprises a base portion 4*a* and a conductive and transparent film 4*b*. The base portion 4*a* is preferably made from the same transparent glass member as that of the tubular glass bulb 2 and shaped like a rod or pipe. The outer diameter f of the base portion 4*a* is set to a value which satisfies a desired discharge distance D between it and the external electrode 6.

The conductive and transparent film 4*b* is formed from a transparent and conductive member such as indium oxide or tin oxide called ITO on an outer peripheral surface of the base portion 4*a*. Both ends of the internal electrode 4 formed as described above are connected to the tubular glass bulb 2 by welding at welding portions 4*c*.

The external electrode 6 may be formed by winding a metal wire spirally around the tubular glass bulb 2 as in the prior art described above. However, in this embodiment, it is formed from a transparent and conductive member such as ITO like the transparent and conductive film 4*b* for the internal electrode 4.

A description is subsequently given of the function and effect of the fluorescent lamp 1 of the present invention configured as described above. Firstly, since the base portion 4*a* is made from a glass member, preferably the same member as the tubular glass bulb 2, even if any temperature change such as a temperature rise caused by turning on the fluorescent lamp 1 or a change in ambient temperature occurs, stress is not applied to the welding portions 4*c* because the tubular glass bulb 2 and the internal electrode 4 have almost the same thermal expansion coefficient.

Strictly speaking, since the conductive and transparent film 4*b* is formed around the base portion 4*a,* the effect of the thermal expansion coefficient of this conductive and transparent film 4*b* must be taken into consideration. However, as the conductive and transparent film 4*b* is very thin on the base portion 4*a* in fact, the effect of the film is extremely small and can be ignored substantially.

Secondly, since the base portion 4*a* and the conductive and transparent film 4*b* are both formed from a transparent member, the entire internal electrode 4 is transparent so that light radiated from the fluorescent film 5 onto the discharge chamber 3 can transmit the internal electrode 4 and reach the fluorescent film 5 on the opposite side. Therefore, as light radiated onto the discharge chamber 3 is not shaded by the internal electrode 4, all the beams of the fluorescent lamp 1 are not lost.

Thirdly, the conductive and transparent film 4*b* performs the substantial function of the internal electrode 4 due to the above configuration. Since the conductive and transparent film 4*b* has typically a resistance value of 10 Ω per $m^2$, even if a portion having a low discharge resistance is produced between the internal electrode 4 and the external electrode 6, an excessive current is prevented from flowing into that portion by the resistance value of the conductive and transparent film 4*b*. Thereby, the formation of a hole in the tubular glass bulb 2 is suppressed.

Since the external electrode is formed of a conductive and transparent film, it can form a perfect surface shape in contrast to a surface resembling shape formed by winding a metal wire spirally around the tubular glass bulb 2 so that electricity can be discharged uniformly, thereby preventing nonuniform brightness produced on the fluorescent film 5 and improving outer appearance to such an extent that a viewer does not recognize the external electrode 6.

As having been described above, according to the present invention, the fluorescent lamp has the following excellent effects. Firstly, since the internal electrode comprises a base portion formed from a transparent glass member having substantially the same thermal expansion coefficient as that of the tubular glass bulb and shaped like a pipe or rod and a conducive and transparent film formed on the surface of the base portion, the thermal expansion coefficient of the internal electrode is made equal to the thermal expansion coefficient of the tubular glass bulb, thereby preventing the damage of the fluorescent lamp caused by temperature variations and improving the reliability of this type of a fluorescent lamp.

Secondly, since the internal electrode is made transparent due to the above configuration so that light radiated from the fluorescent film onto the discharge chamber reaches the fluorescent film on the opposite side without being shaded by the internal electrode, passes through the fluorescent film and is radiated to the outside, all the beams are not lost and the performance of this type of a fluorescent lamp is improved.

Thirdly, since a conductive and transparent film having an appropriate resistance value is made a substantial internal electrode, even if discharge is concentrated on a portion and an excessive current flows into that portion, the current is limited by the resistance value of the conductive and transparent film, thereby preventing the generation of an excessive current. Thus, the formation of a hole in the tubular glass bulb caused by the excessive current is prevented and reliability is improved.

What is claimed is:

1. A fluorescent lamp having a tubular glass bulb forming a discharge chamber, an internal electrode substantially aligned with the axis of the tubular glass bulb in the discharge chamber, a fluorescent film formed on the interior wall of the tubular glass bulb and an external electrode provided around the tubular glass bulb, wherein the internal electrode comprises a base portion made from a transparent glass member having substantially the same thermal expansion coefficient as that of the tubular glass bulb and shaped like a pipe or rod and a conductive and transparent film formed on the surface of the base portion.

2. The fluorescent lamp of claim 1, wherein the external electrode is a conductive and transparent film formed around the tubular glass bulb.

* * * * *

UNITED STATES PATENT AND TRADEMARK OFFICE

CERTIFICATE OF CORRECTION

PATENT NO. : 5,929,564
DATED : July 27, 1999
INVENTOR(S) : Tomio Nakaya, et al.

It is certified that error appears in the above-identified patent and that said Letters Patent is hereby corrected as shown below:

In the Heading, foreign priority should be listed as follows:

-- Foreign Application Priority Data
April 19, 1996 [JP] Japan 8-98660 --

Signed and Sealed this

Eighteenth Day of September, 2001

*Attest:*

Nicholas P. Godici

NICHOLAS P. GODICI
*Acting Director of the United States Patent and Trademark Office*

*Attesting Officer*